United States Patent [19]

Maillet

[11] 4,133,489

[45] Jan. 9, 1979

[54] SHREDDERS, NOTABLY FOR PROCESSING HETEROGENEOUS MATERIALS

[76] Inventor: Edgard J. Maillet, Domaine de l'Ermitage Ludon Medoc, 33290 Blanquefort, France

[21] Appl. No.: 797,167

[22] Filed: May 16, 1977

[51] Int. Cl.[2] ..... B02C 13/284

[52] U.S. Cl. ..... 241/89; 241/89.1

[58] Field of Search ..... 241/37, 87, 88.3, 89, 241/89.1, 89.2

[56] References Cited

U.S. PATENT DOCUMENTS

| | | | |
|---|---|---|---|
| 238,859 | 3/1881 | Cosgrove | 241/88.3 |
| 646,249 | 3/1900 | Williams | 241/88.3 |
| 1,826,157 | 10/1931 | Turucz | 241/89.1 |
| 2,597,333 | 5/1952 | Jindrich | 241/87 |
| 3,804,342 | 4/1974 | Gasparac et al. | 241/37 |
| 3,942,323 | 3/1976 | Maillet | 60/413 |

*Primary Examiner*—Granville Y. Custer, Jr.
*Attorney, Agent, or Firm*—Edwin E. Greigg

[57] ABSTRACT

A rotary comminuting apparatus adjustable to reduce either hard or soft materials includes a segmented perforated semi-cylindrical grate partially surrounding the lower portion of the rotor. The grate segments are pivotally supported on a common axle parallel to the axis of the rotor. The opposite ends of the segments are each supported by a hydraulic jack and the jacks have a common connection to a motor pump unit to pivot the grates from a lower position concentric with the rotor to an upper position in which the outer edge is closer to the rotor surface than the pivot edge.

2 Claims, 1 Drawing Figure

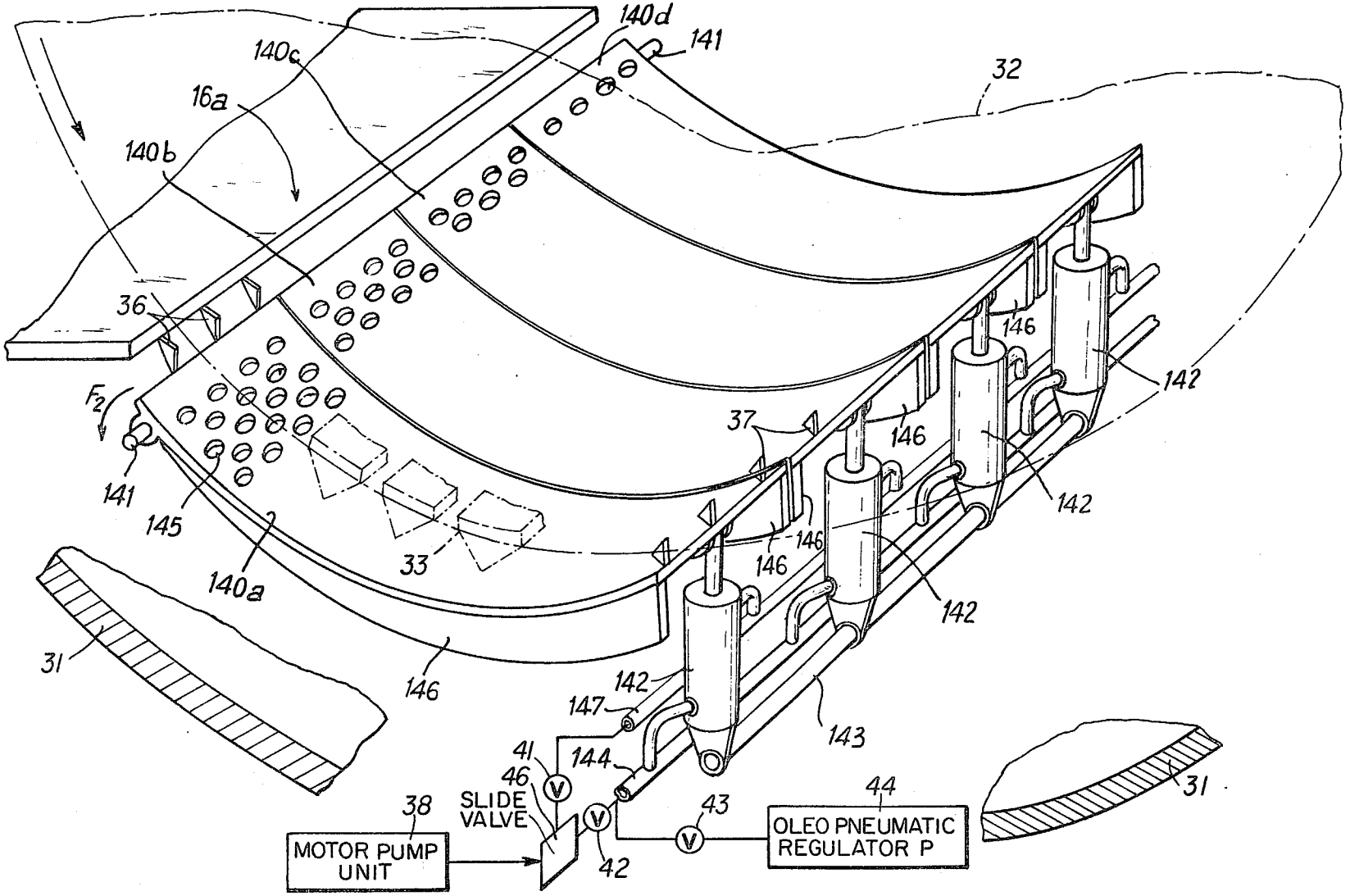
OLEO PNEUMATIC REGULATOR P
SLIDE VALVE
MOTOR PUMP UNIT
31
32
33
36
37
38
41
42
43
44
46
140a
140b
140c
140d
141
142
143
144
145
146
147
16a
F2

SHREDDERS, NOTABLY FOR PROCESSING HETEROGENEOUS MATERIALS

BACKGROUND OF THE INVENTION

1. Field of the Invention

The invention relates to industrial shredders.

2. Description of the Prior Art

The applications of mechanical fragmentation are extremely numerous. Its purpose is to obtain a reduction in dimensions of solid bodies either to facilitate their handling or their packaging, or to enable to facilitate subsequent physical (sorting, proportioning, mixing, etc.), physico-chemical or chemical treatment.

There are also numerous types of equipment to produce fragmentation and they function by various processes such as crushing, shearing, attrition, percussion by projection or by grinding bodies, self-grinding etc. It is obvious that the choice of apparatus depends essentially on the nature of the material to be processed, on its crushing coefficients, and on its susceptibility to breakage or to agglomeration.

Even if it is relatively easy to determine the most suitable fragmentation apparatus for the treatment of a material occuring in the form of an assembly of elements having neighbouring degrees of hardness and of dimensions comprised between given limits, the fragmentation of a material formed of very dissimilar elements poses complex problems.

It is well known that fibrous, elastic or soft materials which are flexible and often tough can only be fragmented by shredding. This is the case, for example, with wood, rubber, leather, organic scraps, thermo-plastic materials, rags, old papers, stuffings, etc. Here again, when the material in bulk to be treated is in the form of an assembly of pieces of the same nature and of comparable dimensions, it is easy to define the characteristics of a blade or spike shredder enabling the desired fragmentation to be obtained. These shredders include a drum or rotor with a horizontal axis provided with shredding tools such as blades, spikes or knives which cooperate if necessary with countertools of which certain ones at least are located at the sill of the feed opening. These shredders are mostly equipped with a force-feeding device.

However, when the material is in pieces which are very different in size and in toughness, for example old papers which can include thick directories or cardboard products, it is necessary, for the purpose of obtaining homogeneous fragmentation, to provide for the possibility of effecting several cycles inside the shredder for the bulkiest and most resistant materials. A concave grate is then arranged, which surrounds the rotor towards the bottom from the sill of the feed opening thus preventing the evacuation of insufficiently fragmented elements which are then driven by the tools of the rotor to be again sheared between the latter and the countertools.

The problem and the solution are the same when there is a risk of the treated material being mixed with bodies of much greater hardness and/or toughness, such as scrap iron or various metallic materials for example. It is necessary in this case to provide a shredder having more robust tools, that is to say a shredder with knives and counter-knives acting at the same time by shearing and by percussion.

It is this same solution which must be adopted when the treated elements are very dissimilar, for example, when it is a question of processing household wastes, abatoir scraps, decanted and possibly dried sewage effluents, etc. After shredding, the fragmented material may be directed to a manual and/or mechanical sorting installation.

Thus in all cases where the material to be shredded exhibits heterogeneity of size, toughness or hardness, the shredder must include under the rotor a retaining grate, to enable recycling of oversize fragments. This is particularly important when the homogeneity of the "shredded product" is necessary for optimum subsequent utilisation, for example, for fiber separation from old papers by the wet method or again for the incineration of waste in a fluidized bed furnace.

Unfortunately, when the material to be treated contains soft and/or fibrous materials, the latter are very often wet on account of water of impregnation but also water contained in the vegetable and animal cells and cause clogging of the holes of the grate.

Experience shows that this clogging starts at the level of the downstream end of the grate, expecially if the counter-tools are arranged in proximity, to be propagated closer and closer in the direction of the upstream end. It has then appeared that to avoid clogging, it sufficed for the grate, instead of being concentric with the rotor, to approach the latter gradually from the feed sill to the opposite end of said grate. Excellent results have been obtained by causing the tools to pass about 40 mm. from the grate at the downstream end of the latter and to 100 or 120 mm at the upstream end.

There then exists a risk of blocking the rotor on the passage of a particularly strong and large mass since its "passageway" narrows as it advances. This risk is particularly important if household wastes are processed in which there are found at the same time fibrous or soft materials such as cardboard packages or organic materials which can cause clogging and very strong and sometimes bulky materials like metal scraps, domestic electrical appliances, etc.

Moreover, if the grate is arranged as has just been stated to avoid clogging, the shredder will not yield optimum results when used for non-clogging dry materials and may even be useless for materials such as scrap iron, slags, etc. due to jamming in the throttling neck formed at the downstream end of the grate.

It is an object of the present invention to provide an improved shredder which overcomes the aforementioned drawbacks.

It is another object of the invention to provide a polyvalent shredder device adaptable for all uses.

Other objects and advantages of the present invention will be apparent from the following description.

BRIEF SUMMARY OF THE INVENTION

According to the invention there is provided an improved shredder, notably for the processing of heterogeneous materials, in which the grate is constituted by a plurality of substantially adjacent segments mounted to rock at their upstream end on a common axis arranged horizontally in the vicinity of the feed sill, while the downstream end of each of said segments is supported in articulated manner by the piston of a hydraulic jack. All the jacks have a common supply controlled from a motor pump unit. This enables the segments to be brought from a lower position in which they rest on a stop and wherein they are substantially concentric with a rotor, to an upper position. When in the upper position, valves provided on the supply ducts permit the jack cylinders to be isolated from the control of the pump unit and to be connected to an oleopneumatic regulator at a substantially constant pressure.

In the upper position, each grate segment can then be lowered in response to passage of a bulky hard mass, to permit the passage thereof and then to return to the alignment of the other segments without jarring or abruptness.

Advantageously, to avoid the fall of material into the space between two segments when only one of them is lowered or when the amplitude of pivoting of two adjacent segments differs from one to the other, each segment includes a rigid skirt along each of its edges, extending in a plane perpendicular to the axis of the rotor.

BRIEF DESCRIPTION OF THE DRAWING

The single FIGURE is a diagrammatic view in perspective of a preferred embodiment of the invention showing the grate constituted by four rocking segments.

DESCRIPTION OF A PREFERRED EMBODIMENT

A shredder not shown in entirety, comprises inside a cage 31, a rotor 32 with horizontal axle provided with knives 33 which cooperate with counter-knives 36, 37 arranged in two lines situated respectively at the two ends of a grate which extends over a portion of the periphery of the rotor from the feed sill formed in the front surface of the cage.

In the FIGURE, only the grate is shown with the feed sill 16*a*.

As shown the grate comprises four contiguous segments 140*a*, 140*b*, 140*c* and 140*d*, which are pivotally mounted on a common horizontal axle 141, arranged adjacent the feed sill 16*a*. Each segment is supported at its downstream end, by a hydraulic jack 142 pivotally mounted on a common axle 143 parallel to axle 141. The jacks 142 have a common supply 144 which enables them to be moved in unison by the operation of a motor pump unit 38.

In actual practice each segment is substantially semi-cylindrical, but as illustrated each extends over a circular arc limited to about 90° for greater clarity.

In the lower position, the grate segments are substantially concentric with the rotor, which is the preferred position, for the fragmentation of scrap iron.

If it is desired to process scraps which include relatively soft or spongy material, to avoid clogging of the holes 145 of the grate, it is necessary to bring the downstream end of each of the segments towards the axis of the rotor, by pivoting around the axle 141 in the direction of the arrow F2. This is accomplished by moving the jacks 142 into their upper position. As soon as this has been effected, a system of valves 41, 42, 43 enables the piping 144 of the motor pump unit to be isolated and to place it in communication with an oleopneumatic regulator 44 at substantially constant pressure. Each grate segment is thus biased toward the rotor but can move away from the rotor in response to an overload caused by an oversized mass. Any blocking is thus avoided inspite of the progressive narrowing of the passage formed for the treated materials. As soon as this load has passed, that is to say recycled to the upper portion of the rotor for further fragmentation, the segments concerned simply return smoothly to their initial upper position due to the balancing action of the oleopneumatic regulator.

It is clear that if all the segments do not pivot together or if they pivot with different amplitudes, materials can escape laterally from the lowest segment between two neighbouring segments. To avoid this, rigid skirts 146 are arranged on each of the edges of each segment so as to block the "gaps" created.

The jacks are in fact double-acting and the cylinders traversed by the piston rods are connected to a common duct 147 connected like the piping 144 to the motor pump unit 38 through a manually operated slide valve 46. This enables the downstream end of the grate to be brought to any desired distance from the rotor. The closing of a valve 41 in the duct 147 and of a valve 42 arranged in the piping 144 completely isolates the jacks 142 from the motor pump unit 38 and the pistons are thus resiliently locked at the desired height for the grate. The duct 144 is then placed in communication with the oleopneumatic regulator 44. Preferably, the latter is of the type claimed in U.S. Pat. No. 3,942,323 filed in the name of applicant.

I claim:

1. In a comminuting apparatus of the type having a rotor carrying knives which cooperate with stationary knives supported on a cage concentric with and extending around the upper portion of the rotor, a grate formed of a plurality of perforated semi-cylindrical contiguous segments each pivoted at one end on a common axle parallel to the axis of the rotor;

an equal number of hydraulic jacks, one supporting the opposite end of each of said segments respectively;

means for raising said jacks in unison to pivot said segments about said axle between a lower position in which said grate is concentric with the rotor and an upper position in which the jack end of the said grate is closer to the surface of the rotor than the pivot end; and means for connecting said jacks when in their upper position to a source of constant pressure to resiliently support said grate in said upper position.

2. Apparatus as defined by claim 1 in which each of said segments includes radially outwardly extending parallel skirt portions along the circumferential edges thereof.

* * * * *